US005984345A

United States Patent [19]

Carter

[11] Patent Number: 5,984,345

[45] Date of Patent: Nov. 16, 1999

[54] MOUNTING PLATFORM FOR "HEEL-LESS" TYPE SKI BINDINGS AND METHOD FOR USING THE SAME

[76] Inventor: Nicholas J D Carter, 44 Banbury Dr., Youngstown, Ohio 44511

[21] Appl. No.: 08/810,911

[22] Filed: Mar. 5, 1997

[51] Int. Cl.[6] ..... A63C 9/10

[52] U.S. Cl. ..... 280/633; 280/611; 280/11.32

[58] Field of Search ..... 280/611, 614, 280/615, 617, 618, 633, 636, 623, 11.31, 11.32

[56] References Cited

U.S. PATENT DOCUMENTS 3,219,359 11/1965 Schneider ..... 280/11.35
3,977,688 8/1976 Imagawa ..... 280/633

*Primary Examiner*—Robert J. Oberleitner
*Assistant Examiner*—C. T. Bartz
*Attorney, Agent, or Firm*—Bruce E. Dahl, Esq.; Dahl & Osterloth, LLP

[57] ABSTRACT

A mounting platform assembly for attaching a "heel-less" type of binding to a ski may comprise a toe platform having a top surface and a bottom surface and having a plurality of holes extending therethrough for receiving a plurality of platform screws. The toe platform also includes at least two threaded holes therein for receiving at least two mounting screws of the binding. The toe platform is attached to the ski by the platform screws, whereas the toe piece of the "heel-less" binding is attached to the toe platform by the mounting screws. A heel platform may be mounted to the ski at a position rearward from the toe platform by heel platform screws.

5 Claims, 3 Drawing Sheets

MOUNTING PLATFORM FOR "HEEL-LESS" TYPE SKI BINDINGS AND METHOD FOR USING THE SAME

FIELD OF THE INVENTION

This invention relates to "heel-less" type ski bindings in general and more specifically to improvements for telemark ski bindings.

BACKGROUND

Telemark skiing is often thought of as a cross between downhill skiing and cross-country skiing. Like cross-country skiing, the heel of a telemark boot is not secured to the ski, i.e., it is a "heel-less" binding. However, the toe piece of a telemark binding generally provides a more secure attachment of the toe of the boot to the ski than does a cross-country ski binding. Also, the ski boots for telemark skiing are generally heavier than those used for cross-country skiing. Consequently, a telemark ski, boot, and binding outfit generally provides superior control over a cross-country outfit, albeit not to the same degree as does an alpine (commonly referred to as "downhill") ski, boot, and binding assembly.

One problem associated with telemark ski bindings is that the mounting screws that secure the toe piece to the ski tend to work loose over time. If the mounting screws are not kept securely tightened, the holes in the ski will tend to become enlarged, preventing further tightening of the binding mounting screws. Worse yet, the holes may fail during actual skiing, causing the binding to detach from the ski. Besides being a significant inconvenience, the detaching binding may cause personal injury to the skier.

In an effort to ameliorate this problem, some skiers install threaded inserts into their skis. The mounting screws of the binding are then secured to the threaded inserts. While such threaded inserts provide a more secure attachment of binding to ski, the binding may still pull loose from the ski when subjected to heavy loads of the type that may be imposed by an accidental fall or by expert or "extreme" telemark skiers.

SUMMARY OF THE INVENTION

A mounting platform assembly for attaching a "heel-less" type binding to a ski may comprise a toe platform having a top surface and a bottom surface and having a plurality of holes extending therethrough for receiving a plurality of platform screws. The toe platform also includes at least two threaded holes therein for receiving at least two mounting screws of the binding. The toe platform is attached to the ski by the platform screws, whereas the binding is attached to the toe platform by the mounting screws. A heel platform may be mounted to the ski at a position rearward from the toe platform by heel platform screws.

Also disclosed is a ski and "heel-less" type binding assembly that includes a ski with a top surface and a bottom surface. A toe platform also having a top surface and a bottom surface is mounted to the ski so that the bottom surface of the toe platform is adjacent the top surface of the ski. A "heel-less" binding toe piece is in turn mounted to the toe platform. The arrangement is such that the binding is attached to the toe platform while the toe platform is attached to the ski. A heel platform may also be attached to the ski at a position rearward from the toe platform so that the heel platform is substantially aligned with the heel portion of the ski boot.

A method for attaching a "heel-less" type binding to a ski according to the present invention may comprise the step of providing a toe platform having a top surface and a bottom surface. The toe platform includes a plurality of holes therein that extend from the top surface of the toe platform through to the bottom surface of the toe platform and are adapted to receive a plurality of corresponding platform screws. The toe platform also includes a plurality of threaded holes therein adapted to receive a corresponding plurality of binding mounting screws. The toe platform is then attached to the ski with the corresponding plurality of platform screws. Next, the toe piece of the "heel-less" type ski binding is attached to the toe platform with the corresponding plurality of binding mounting screws.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
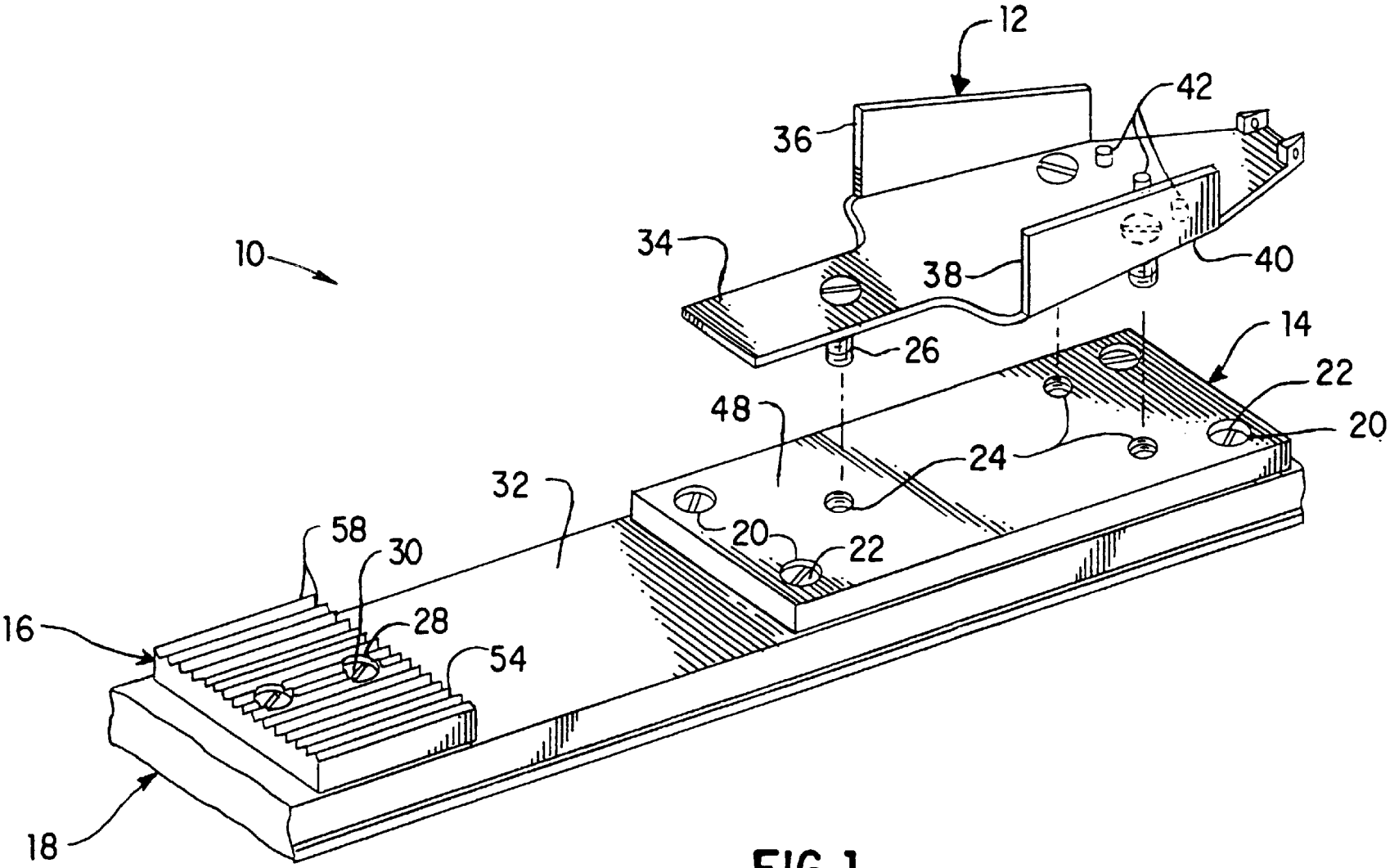
FIG. 1 is an exploded perspective view of the mounting platform assembly according to the present invention as it could be used with a three-pin type telemark ski binding.

A mounting platform assembly 10 according to the present invention is shown in FIG. 1 as it could be used to mount to a ski 18 a "heel-less" type of ski binding, such as a telemark ski binding 12. As used herein, the term "heel-less" refers to those types of ski bindings that do not require that the heel of the ski-boot be directly fastened to the ski. Examples of such "heel-less" ski bindings include, but are not limited to, telemark ski bindings (either cable type or pin type), cross country ski bindings, and mountaineering bindings. Essentially, the mounting platform assembly 10 may comprise a toe platform 14 and a heel platform 16. The toe platform 14 may include a plurality of through holes 20 for receiving a corresponding plurality of platform screws 22. The platform screws 22 are used to secure the toe platform 14 to the ski 18. The toe platform 14 also includes a plurality of threaded holes 24 sized and spaced to receive corresponding binding mounting screws 26. The threaded holes 24 provide a means for securing the binding 12 to the toe platform 14. The heel platform 16 includes a plurality of through holes 28 and is mounted to the ski 18 at a position rearward from the position of the toe platform 14 by a plurality of corresponding heel platform screws 30.

A significant advantage associated with the mounting platform assembly 10 according to the present invention is that the toe platform 14 provides a means to more securely fasten the binding toe piece 12 to the ski 18, thereby reducing the tendency for the binding toe piece 12 to work loose or become detached from the ski 18. The improved mounting security results primarily from two factors. First, the toe platform 14 is secured to the ski 18 by more screws, e.g., four (4) platform screws 22 instead of three (3) mounting screws 26, in the example shown in FIG. 1. Second, the screws 22 are spaced further apart compared with the binding mounting screws 26 associated with the binding toe piece 12. The increased spacing distributes the forces over a larger area on the ski 18.

Another advantage associated with the mounting platform assembly 10 is that the toe and heel platforms 14 and 16 elevate binding toe piece 12, thus the skier's boot (not shown) over the top surface of the ski 18. The increased elevation gives the skier increased leverage against the ski 18, which tends to improve control and overall "feel," both of which tend to enhance the skiing experience. The increased elevation also reduces the tendency of the binding to drag in the snow, which can be a problem for all types of skiers. Binding drag can also be a problem on steep slopes.

Having briefly described the mounting platform assembly 10 according to the present invention, as well as some of its more significant features and advantages, the mounting platform assembly 10 will now be described in detail.

Still referring to FIG. 1, the mounting platform assembly 10 is shown as it could be used to mount a "heel-less" type of ski binding, such as a telemark ski binding 12, to the top surface 32 of a ski 18. As mentioned above, the term "heel-less" refers to those types of ski bindings that do not directly fasten the heel of the ski-boot (not shown) to the surface of the ski, such as telemark ski bindings, cross country ski bindings, and mountaineering ski bindings.

For the purposes of illustrating and explaining the features of the present invention, the mounting platform 10 is shown and described herein as it could be used with a pin-type of telemark of ski binding 12, although it could also be used with other types of "heel-less" bindings of the type described above. Also, the particular type of telemark ski binding that is shown and described herein is generic of the type only and is not meant to be representative of any particular type of telemark binding. Having clarified that point, the telemark ski binding 12 may comprise an integral structure having a sole plate 34 and having a pair of upturned sides or flanges 36, 38 that define a toe portion 40. Since the binding 12 is a "pin type" telemark binding, the toe portion 40 may also include a plurality of pins 42 for engaging corresponding holes in the bottom of the toe portion of a ski boot (not shown). While the binding 12 shown and described herein includes three (3) pins 42, the "pin type" binding 12 could incorporate a greater or lesser number of pins 42. Alternatively, the binding 12 could comprise a "cable type" binding having no pins at all. Referring back not to the particular "pin type" telemark binding shown in FIGS. 1–3, the binding 12 may also include a toe bar 44 (not shown in FIG. 1, but shown in FIG. 2) for securing the boot to the binding 12. Once the ski boot (not shown) is fit over the pins 42, the toe bar 44 is brought down over the tip of the boot and secured by a latch member 46 (FIG. 2), thereby securing the boot (not shown) to the binding 12. The binding 12 may also include a spring-biased cable assembly (not shown) for engaging the heel portion of the boot. The binding 12 thus allows the skier to raise the heel portion of the boot while the toe portion remains firmly engaged with the binding 12, thus ski 18.

Figure 2:
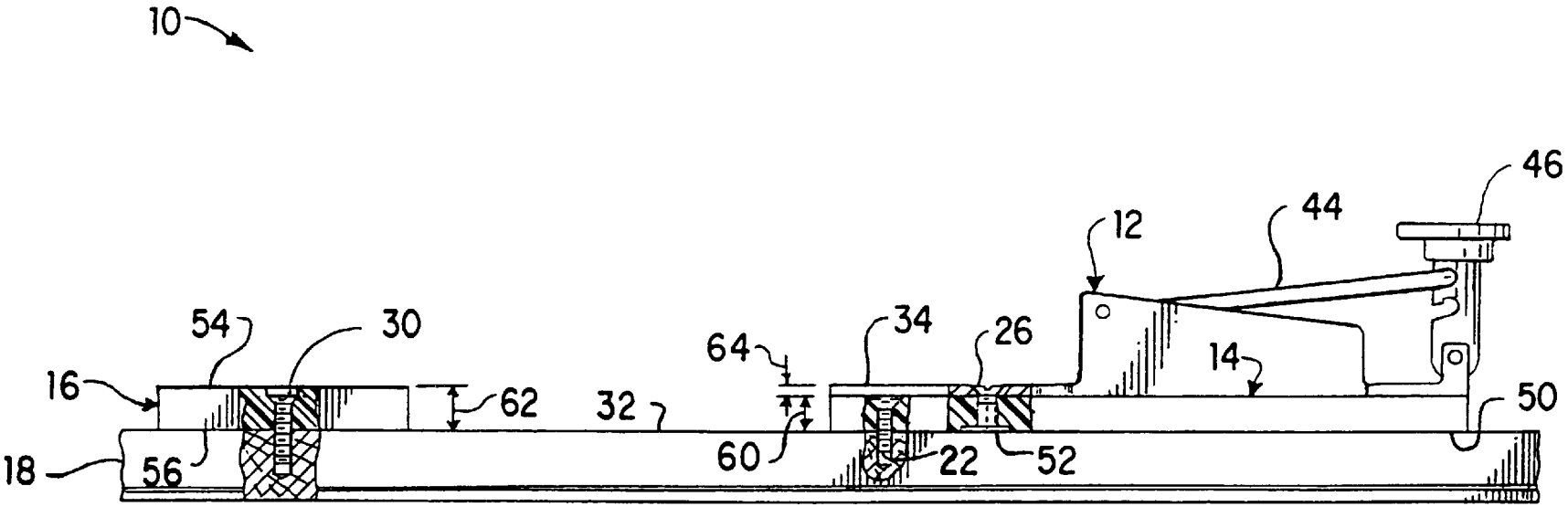
FIG. 2 is a side view in elevation partially in section showing the arrangement for fastening the toe platform to the ski and the binding to the toe platform.

In one preferred embodiment, the toe platform 14 comprises a generally rectangular member having a top surface 48 (FIG. 1) and a bottom surface 50 (FIG. 2). However, the toe platform 14 need not be generally rectangular and could comprise other shapes, e.g., it could be hour-glass shaped. The toe platform 14 includes four (4) through holes 20 positioned at about the corners of the toe platform 14. Each through hole 20 extends through the toe platform 14 from the top surface 48 to the bottom surface 50 and is sized to receive a platform screw 22. In one preferred embodiment, each through hole 20 is countersunk to accommodate a flat-head platform screw 22, as best seen in FIG. 2. Toe platform 14 also includes three (3) threaded holes 24 sized and spaced to receive the corresponding binding mounting screws 26, as best seen in FIG. 1. It should be noted that the toe platform 14 could include a greater or lesser number of threaded holes 24, depending on the particular number of binding mounting screws 26 that are associated with the binding 12. In one preferred embodiment, the threaded holes 24 are provided by utilizing a plurality of T-nuts 52 which are held captive within the toe platform 14. See FIG. 2. Alternatively, the threaded holes 24 could be provided by threaded inserts (not shown), or even by threads tapped directly into the toe platform 14, as will be described in greater detail below.

The toe platform 14 may be made from any of a wide range of materials suitable for the expected use of the toe platform 14. For example, in one preferred embodiment, the toe platform 14 is made from UHMW ultra high molecular weight type plastic, although other types of plastic materials may also be used. One advantage associated with the UHMW type of plastic is that it repels snow, thus helping to prevent the accumulation of snow between the ski boot and toe platform 14. Alternatively, the toe platform 14 may be made from other materials, such as aluminum, titanium, steel, or various metal alloys. In still another alternative, the toe platform 14 may comprise a composite or laminate material (e.g., a wood and fiberglass laminate), or, simply, wood. Accordingly, the toe platform 14 should not be regarded as limited to any particular material.

If the toe platform 14 is made from a plastic material, such as UHMW plastic, then it will usually be desirable to form the threaded holes 24 by using metal T-nuts 52 (FIG. 2). Alternatively, threaded metal inserts (not shown) may be used. The T-nuts 52 or threaded inserts may be molded directly into the plastic material comprising the toe platform 14 or may be installed after the piece is molded, depending on the preferred method for installing such threaded inserts. If the toe platform 14 is manufactured from a metal or a metal alloy, then it may be possible to form the threaded holes 24 by tap threading holes in the toe platform 14.

The heel platform 16 may comprise a generally rectangularly shaped member having a top surface 54 (FIG. 1) and a bottom surface 56 (FIG. 2). However, as was the case for the toe platform 14, the heel platform 16 need not necessarily be rectangular in shape and could instead comprise other shapes. Heel platform 16 also includes a pair of through holes 28 that extend through the heel platform 16 from the top surface 54 to the bottom surface 56 and are sized to receive a corresponding pair of heel platform screws 30. As was the case for the toe platform 14, it is preferred, but not required, that the holes 28 be countersunk to accommodate flat-head heel platform screws 30, as best seen in FIG. 2. The heel platform screws 30 are used to fasten the heel platform 16 to the top surface 32 of the ski 18. The top surface 54 of heel platform 16 may also include a plurality of longitudinal ridges or grooves 58 to provide enhanced engagement with the heel (not shown) of the ski boot (also not shown) when the same is engaged with the heel platform 16.

The heel platform 16 may be made from any of a wide range of materials. In one preferred embodiment, the heel platform comprises UHMW type plastic, although other types plastic materials could also be used. Alternatively, the heel platform 16 could be made from any of a wide variety of metals, such as, for example, aluminum, titanium, or steel, metal alloys, composites, laminates, or wood.

The respective thicknesses 60, 62 of the toe platform 14 and the heel platform 16 should be such that they provide a substantially equal elevation over the top surface 32 of the ski 18. Referring now to FIG. 2, the thickness 60 of the toe platform 14 will generally be less than the thickness 62 of the heel platform 16. The difference in thicknesses 60 and 62 between the toe platform 14 and the heel platform 16 should be about equal to the thickness 64 of the sole plate 34 of the binding 12. Put in other words, the sum of the thickness 60 of the toe platform 14 and the thickness 64 of the sole plate 34 should be about equal to the thickness 62 of the heel platform 16. Accordingly, the total thickness of the toe platform 14 and sole plate 34 will be about equal to the thickness 62 of the heel platform 16, thereby providing equal elevation above the top surface 32 of the ski 18.

The thickness of the toe platform 14 may be in the range of about 12 mm to 25 mm, with a thickness of about 17 mm being preferred. Similarly, the thickness of the heel platform 16 may be selected so that it provides approximately the same elevation as the toe platform 14 and binding assembly 12. Accordingly, the heel platform 16 may be in the range of about 12 mm to 25 mm, with a thickness of about 17 mm being preferred. Alternatively, the heel platform 16 may be slightly thinner than the toe platform 14 to lower the position of the heel of the ski-boot (not shown).

The binding assembly 12 can be attached to the ski 18 by first attaching the toe platform 14 to the top surface 32 of ski 18 by screwing the four (4) platform screws 22 into the ski 18. The binding 12 may then be attached to the toe platform 14 by screwing the three (3) mounting screws 26 into the corresponding threaded holes 24. The heel platform 16 may be mounted to the ski 18 at a position to the rear of the toe platform 14 by the pair of heel platform screws 30 so that the heel platform 16 will be generally aligned with the heel (not shown) of the ski boot (also not shown) when the ski boot is engaged with the binding 12. The resulting assembly provides a rugged and secure mounting of the binding 12 to the ski 18. The elevated position of the binding 12 above the top surface 32 of the ski 18 also provides for improved control, skier "feel," and reduces binding drag.

Figure 3:
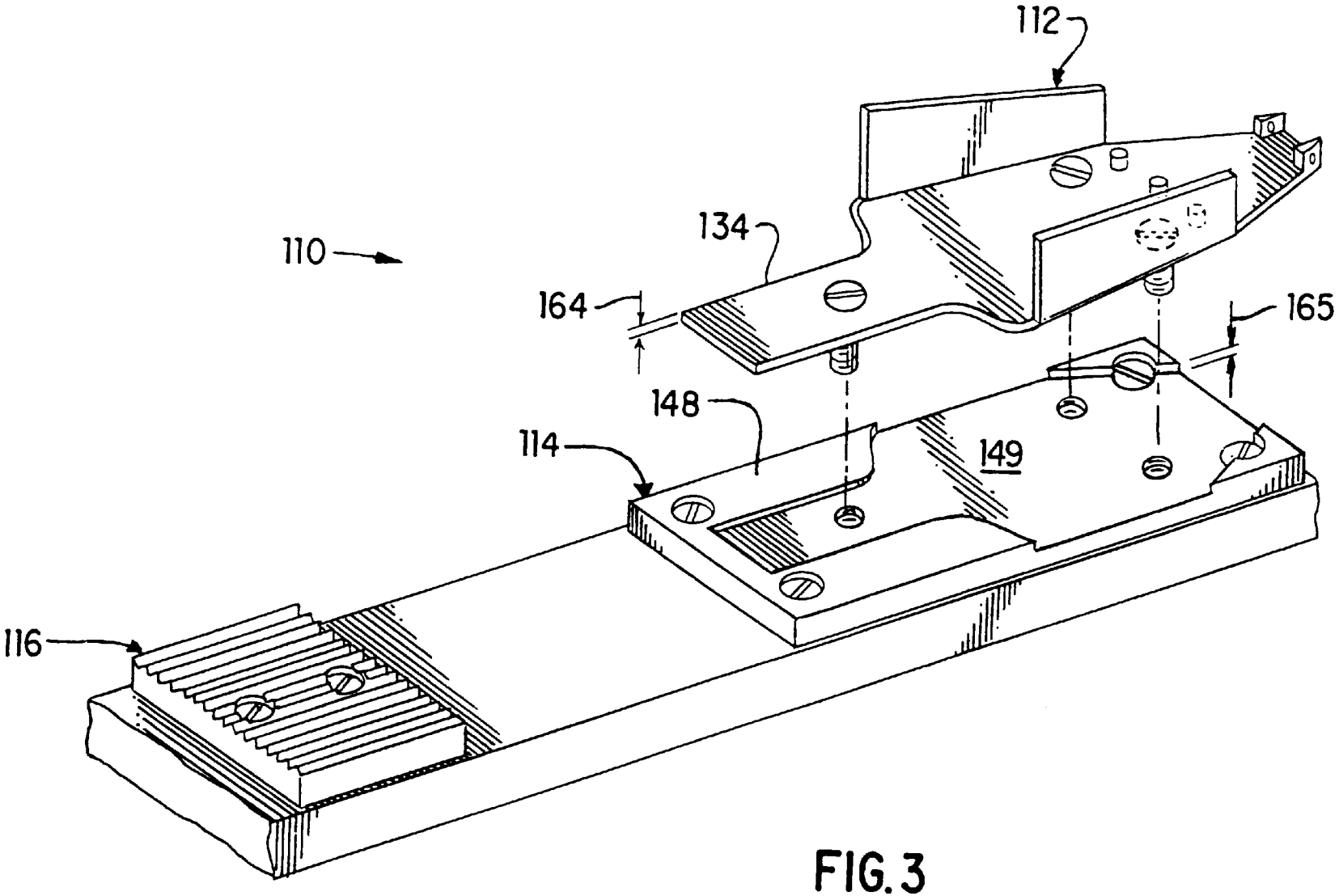
FIG. 3 is an exploded perspective view of another embodiment of the mounting platform assembly having a recessed toe platform.

Another embodiment 110 of the mounting platform assembly is shown in FIG. 3. The mounting platform assembly 110 shown in FIG. 3 is essentially identical to the mounting platform assembly 10 shown in FIGS. 1 and 2, except that it includes a recessed toe platform 114. Specifically, the recessed toe platform 114 includes a recessed area 149 in its top surface 148. The recessed area 149 has a depth 165 that is substantially equal to the thickness 164 of the sole plate 134 of binding 112. The recessed toe platform 114 thus provides a recessed fit for the binding 112. The mounting platform assembly 110 may also include a separate heel platform 116, as was the case for the first embodiment 10.

This completes the detailed description of the preferred embodiments of the present invention. While a number of specific components were described above for the preferred embodiments of this invention, persons having ordinary skill in the art will readily recognize that other substitute components or combinations of components may be available now or in the future to accomplish comparable functions to the various components shown and described herein. For example, while the toe and heel platforms shown and described herein comprise generally rectangular members, many other shapes are possible, such as hour-glass shapes, "free-form" shapes, etc., so long as the toe platform is shaped to support the sole plate of whatever type of binding is being used. Also, while the toe and heel platforms shown and described herein comprise separate members, they could comprise an integral portion of the ski. That is, the toe and heel platform members could be added to the to surface of the ski during manufacture. The platforms may then be covered with the top sheet laminate placed over the top surface of the ski.

Accordingly, it should be understood that the inventive concepts herein described may be variously otherwise embodied and it is intended that the appended claims be construed to include alternative embodiments of the invention except insofar as limited by the prior art.

What is claimed is:

1. A mounting platform assembly for attaching a "heel-less" type of binding to a ski, the "heel-less" binding having at least one mounting screw, comprising:

a toe platform having a top surface and a bottom surface and a plurality of holes extending therethrough for receiving a plurality of platform screws, said toe platform also including at least one threaded hole therein for receiving the mounting screw of the binding; and a heel platform adapted to be mounted to the ski at a rearward position from said toe platform so that said heel platform will be located at a position about in alignment with a heel portion of a boot attached to the binding, said heel platform having a top surface and a bottom surface, the top surface having a plurality of longitudinal ridges therein, said heel platform also having at least one hole therethrough extending from the top surface to the bottom surface for receiving a heel platform screw.

2. A mounting platform assembly in combination with a "heel-less" ski binding toe piece having at least one mounting screw, said mounting platform assembly comprising:

a generally rectangularly shaped toe platform having a top surface and a bottom surface;

a plurality of holes extending through said toe platform from the top surface to the bottom surface, said plurality of holes being sized to receive a plurality of platform screws for mounting said toe platform to a ski;

at least one threaded hole in said toe platform for receiving the mounting screw of the "heel-less" ski binding toe piece; and a heel platform adapted to be mounted to the ski at a rearward position from said toe platform, said heel platform comprising a generally rectangular member having a top surface and a bottom surface, the top surface having a plurality of longitudinal ridges therein, said heel platform also having at least one hole therethrough extending from the top surface to the bottom surface for receiving a platform screw.

3. A ski and binding assembly, comprising:

a ski having a top surface and a bottom surface;

a generally rectangularly shaped toe platform having a top surface, a bottom surface, at least one hole therethrough extending from the top surface of said toe platform to the bottom surface of said toe platform said toe platform, and at least one threaded hole therein;

a platform screw sized to be received by the hole in said toe platform so that said platform screw attaches said toe platform to said ski so that the bottom surface of the toe platform is adjacent the top surface of said ski;

a "heel-less" binding comprising a toe piece and having at least one hole therethrough;

a mounting screw sized to be received by the hole in said "heel-less" binding and the threaded hole in said toe platform so that said mounting screw attaches said "heel-less" binding to the top surface of said toe platform;

a heel platform mounted to said ski at a rearward position from said toe platform, said heel platform comprising a generally rectangularly shaped member having a top surface and a bottom surface, said heel platform also having at least one hole therethrough extending from the top surface to the bottom surface for receiving a platform screw, wherein the top surface of said heel platform includes a plurality of longitudinal ridges and wherein said heel platform has a thickness that is about equal to a combined thickness of said toe platform and a sole plate associated with said "heel-less" binding so that a heel portion of a ski boot engaging the toe piece of said "heel-less" binding engages said heel platform at a position above the top surface of said ski that is about equal to a position above the top surface of said ski for a toe portion of the boot when the boot is secured to said "heel-less" binding.

4. The ski and binding assembly of claim 3, wherein said toe platform and said heel platform comprise a plastic material.

5. The ski and binding assembly of claim 4, wherein said plastic material comprises UHMW.

* * * * *